US005405148A

United States Patent [19]

Cianci

[11] Patent Number: 5,405,148

[45] Date of Patent: Apr. 11, 1995

[54] BOARD GAME APPARATUS

[76] Inventor: Richard C. Cianci, 53 Wolcott Hill Rd., Apt. B-12, Wethersfield, Conn. 06109

[21] Appl. No.: 207,413

[22] Filed: Mar. 8, 1994

[51] Int. Cl.[6] ..... A63F 3/00

[52] U.S. Cl. ..... 273/273; 273/282.1; 273/290; 273/141 R; 446/368; 446/73

[58] Field of Search ..... 273/141 R, 236, 273, 273/287, 290, 288, 282.1, 447, 448, 440, 140; 446/368, 76, 73, 310, 311

[56] References Cited

U.S. PATENT DOCUMENTS

| | | | |
|---|---|---|---|
| 608,794 | 8/1889 | Quinn | 446/310 |
| 685,345 | 10/1901 | Perkins et al. | 446/310 |
| 951,701 | 3/1910 | Roblin | 273/141 R |
| 1,420,400 | 6/1922 | Ayre | 273/273 |
| 2,542,368 | 11/1970 | Ashley | 273/282.1 |
| 3,091,053 | 5/1973 | Growald | 446/320 X |
| 3,602,515 | 9/1971 | Seidman | 273/141 R |
| 3,895,805 | 7/1975 | Enos | 273/287 |
| 4,081,183 | 3/1978 | Urban | 273/249 |
| 4,147,358 | 4/1979 | Erickson | 273/241 |
| 4,696,477 | 9/1987 | Tsuzuki | 273/241 |
| 4,881,915 | 11/1989 | Liaw | 446/153 |
| 4,991,854 | 2/1991 | Weiss | 273/249 |
| 5,037,111 | 8/1991 | Hofmann | 273/248 |
| 5,062,645 | 11/1991 | Goodman | 273/249 |

FOREIGN PATENT DOCUMENTS

| | | | |
|---|---|---|---|
| 1107850 | 6/1968 | United Kingdom | 273/243 |

*Primary Examiner*—Benjamin H. Layno

[57] ABSTRACT

An exhilarating childrens' amusement game allowing participants to compete in the hatching and collecting of dinosaur like figurines. Utilizing a spinner device control-member, participant take turns, choosing from the hatchery game board, trying to match the dinosaur which has been spun and landed on, competing to be the first to hatch and collect the different needed dinosaur game pieces to be declared the winner.

6 Claims, 2 Drawing Sheets

BOARD GAME APPARATUS

BACKGROUND OF THE INVENTION

1. Field of the Invention

The present invention is directed to games for childrens amusement and memorization purposes and, more particularly, to games of the type which utilize a game board, a plurality of game pieces, a control-member, such as that of cardboard spinner apparatus and a die.

2. Description of the Prior Art

Prior art which employs game boards, game pieces and control members are recognized and numerously well known. Examples of such prior art reveal U.S. Pat. Nos. 608,794 Quinn to 5,062,645 Goodman. As revealed in U.S. Pat. No. 4,147,358 Erickson, a game board, game pieces and a control member are utilized, examination shows its object to be the last surviving dinosaurs from falling through the cracks in the game board surface. Again, upon examining U.S. Pat. No. 4,081,183 Urban a game board, game pieces and control-member are utilized. One can safely state, that many prior art inventions employ game boards, game pieces and control member, all of which have different objectives and claims.

Although the present invention also employs a game board, game pieces and control member, prior art does not reveal a game apparatus which allows players to compete in the hatching and collecting of dinosaur game pieces to be declared the winner. That is what the present invention offers, such a concept would tend to intrigue participants.

SUMMARY OF THE PRESENT INVENTION

It is a primary object of the present invention to provide a game for amusement and memorization purposes, in which, game piece collection is controlled by the control member spinner apparatus, chance, and a participants ability to memorize.

It is another object of the present invention to allow participants to compete in the hatching and collecting of the needed dinosaur game pieces to win the game.

In a further object, the game piece dinosaurs of the present invention could be utilized as another activity, much like that of plastic army men, constituting as a multi-use invention.

To this end, the game of the present invention is comprised in combination with a playing surface, various game piece dinosaur figurines, a plurality of hatchable eggs, a spinner device and a die to determine who starts the game.

The present invention will accommodate 2–5 players. Prior to start of play, participants insert one game piece dinosaur per hatchable egg, placing them into a paper bag, when all eggs are filled, the bag is shaken and the unhatched eggs are then placed onto the game board, known as the hatchery. At this time players roll the die, highest number starts and play then continues clockwise. The first player spins the control member to see what type of dinosaur he or she must hatch, player then picks an egg from the hatchery and discreetly opens the hatchable egg, if the dinosaur game piece inside the egg matches that of the spinner device, player then retains that particular dinosaur game piece, returning the empty egg back to the hatchery. However, if no match is obtained, then the player must return the unhatched egg to the hatchery, making mental note of the type of dinosaur game piece inside the egg and its location in the hatchery.

If at any time a player spins and lands on a dinosaur game piece already obtained, they may elect to pass or go to the hatchery and pick an egg to inspect its content and location, returning it back to the hatchery.

Play continues until a player obtains the four different type dinosaur game pieces needed declaring them the winner.

BRIEF DESCRIPTION OF THE DRAWINGS

The present invention will be more easily comprehended with reference to the following detailed description, when taken in conjunction with the accompanying drawings, wherein.

DESCRIPTION OF PREFERRED EMBODIMENT

Figure 1:
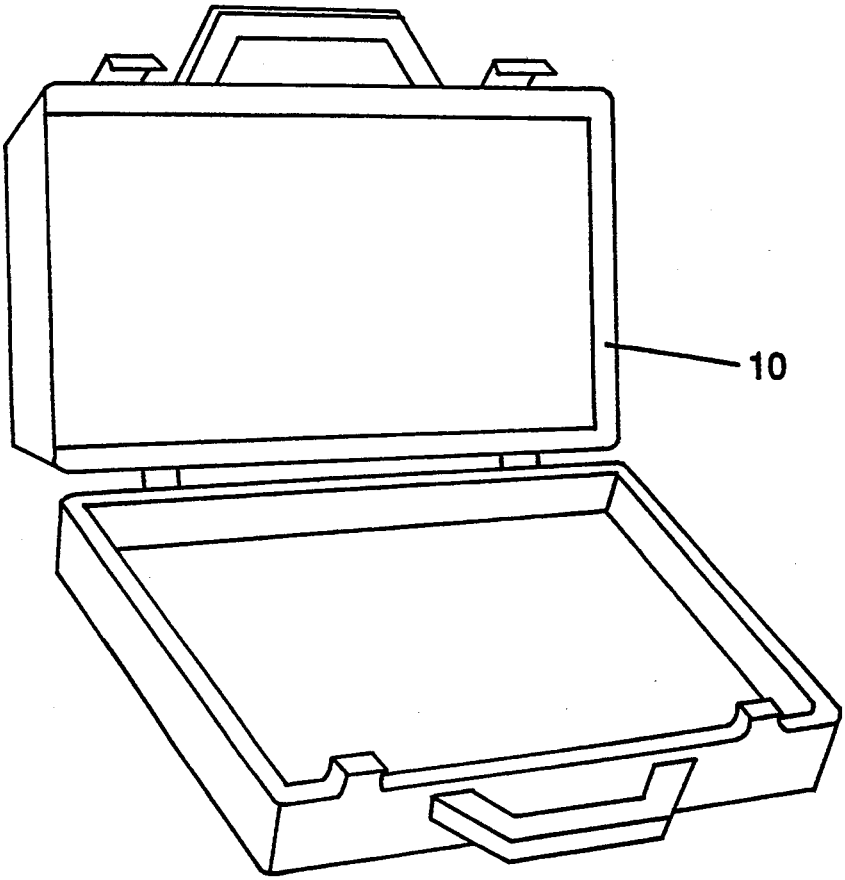
FIG. 1 is a perspective top view of the carrying case.
Figure 2:
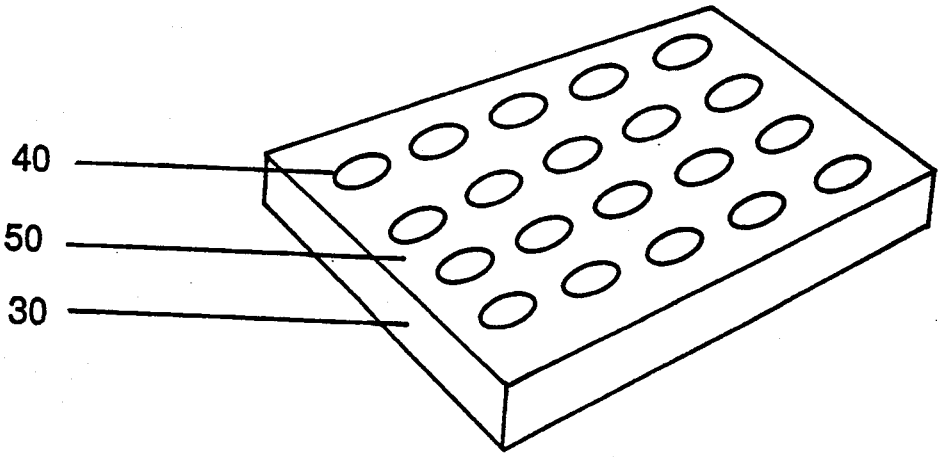
FIG. 2 is a top view of the game board.
Figure 3:
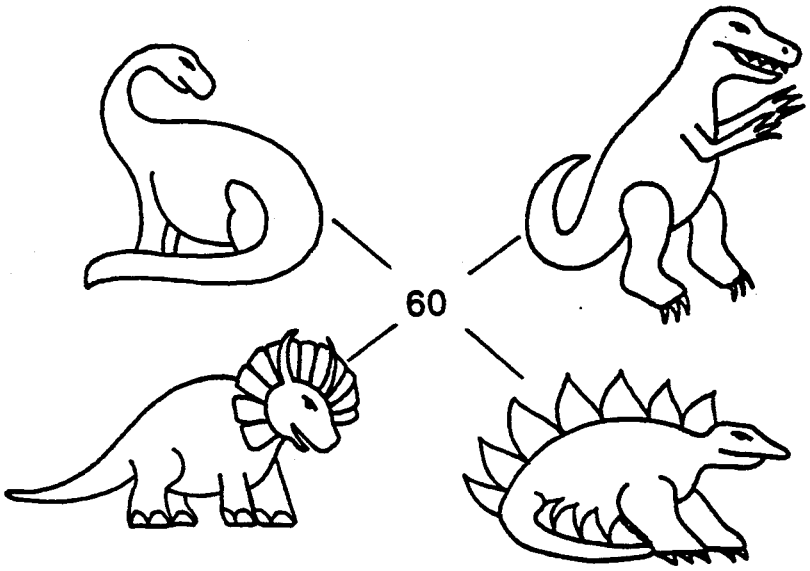
FIG. 3 is a perspective view of the dinosaur game pieces.
Figure 4:
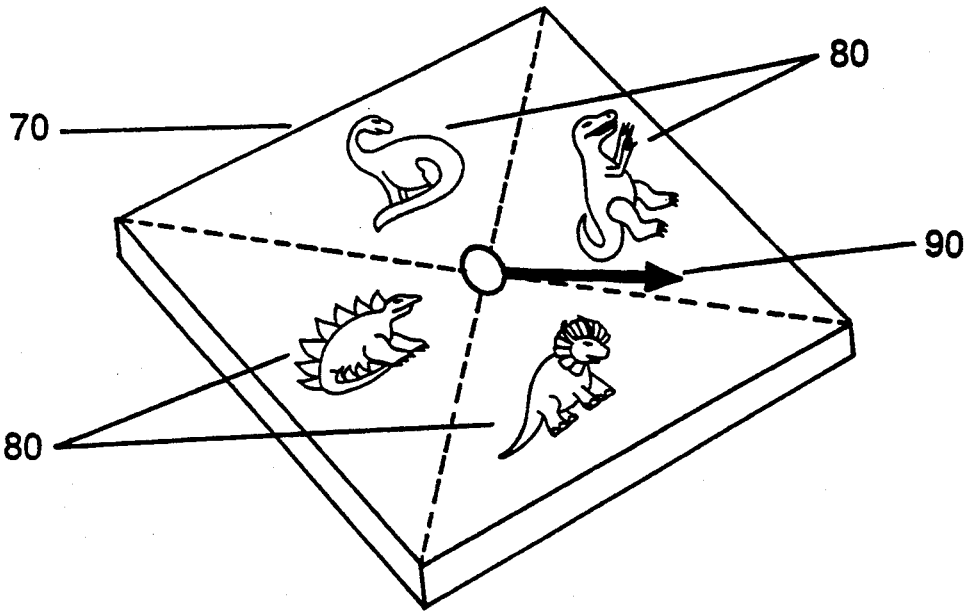
FIG. 4 is a top view of the control member apparatus.
Figure 5:
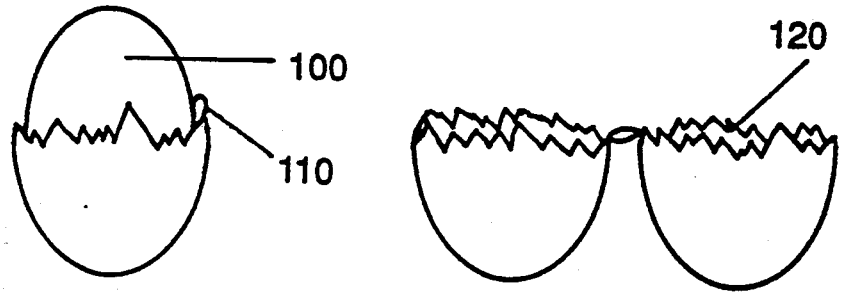
FIG. 5 is a plan view of the hatchable egg, hatched and unhatched.

Referring to the drawings of the present invention. Shown in FIG. 1 is the carrying case 10 made of mould plastic, having a bottom portion 20 in which the hatchery game board 30 of FIG. 2 is permanently adhered to the carrying case 10 bottom portion 20 by glue or a two part fastening system, such as velcro. The hatchery game board 30 of FIG. 2 made of resilient soft foam rubber or the like, with its recessed sockets 40 having a top surface 50 resembling what would appear to look like that of sand. FIG. 3 shows the four different type dinosaur game pieces 60 made of mould plastic, five sets of four totaling twenty dinosaur game pieces 60. Shown in FIG. 4 is the spinner device 70 made of durable cardboard. Shown on the face surface of the spinner device 70 are the four different type dinosaurs 80 utilized. A plastic indicator 90 is permanently riveted to the cardboard spinner device 70. FIG. 5 shows a container in the shape of a hatchable egg 100 made of mould plastic, with a plastic strap 110 to act as a hinge, also shown is the hatchable egg 100 in its open or hatched 120 position.

Having described the invention, modifications thereto will become apparent to those skilled in the art to which it pertains, without deviating from the spirit of the invention as defined by the scope of the appended claims.

I claim:

1. A hatch and collect game apparatus comprising in combination:

a plastic carrying case a game board adapted to be received in said carrying case, said game board comprising a top surface having a plurality of recessed sockets;

a chance device comprising a plurality of different objects illustrated thereon, wherein when said chance device is operated only one of said objects is selected;

a plurality of playing pieces representing all of said different objects, wherein each playing piece is shaped to represent one of said different objects;

a plurality of containers, each container adapted to receive only one of said playing pieces, each container having a lid for enclosing and concealing the playing piece from view, each container adapted to be securely received in any one of said recessed sockets.

2. The game apparatus of claim 1 wherein said carrying case is made of mould plastic and said game board is permanently adhered to the bottom portion of said carry case.

3. The game apparatus of claim 1 wherein said game board be made of resilient soft foam rubber, having a top surface resembling sand surrounding said recessed sockets.

4. The game apparatus of claim 1 wherein said plurality of playing pieces represent dinosaur figures made of mould plastic.

5. The game apparatus of claim 1 wherein said chance device is a spinner having a base made of durable cardboard with a riveted plastic indicator, the base having a top surface divided into a plurality of sectors, each sector having an illustration of one of said different objects.

6. The game apparatus of claim 1 wherein said plurality of containers represent hatchable eggs made of mould plastic.

* * * * *